US007103272B2

(12) United States Patent
Baxter

(10) Patent No.: US 7,103,272 B2
(45) Date of Patent: Sep. 5, 2006

(54) WATER HEATER AND METHOD OF OPERATING THE SAME

(75) Inventor: Jeffrey R. Baxter, Columbia, TN (US)

(73) Assignee: Apcom, Inc., Franklin, TN (US)

( * ) Notice: Subject to any disclaimer, the term of this patent is extended or adjusted under 35 U.S.C. 154(b) by 0 days.

(21) Appl. No.: 11/061,058

(22) Filed: Feb. 18, 2005

(65) Prior Publication Data

US 2005/0147401 A1 Jul. 7, 2005

Related U.S. Application Data

(62) Division of application No. 10/782,703, filed on Feb. 19, 2004.

(60) Provisional application No. 60/448,245, filed on Feb. 19, 2003.

(51) Int. Cl.
*F24H 1/20* (2006.01)

(52) U.S. Cl. ..... 392/454; 392/498

(58) Field of Classification Search ..... None
See application file for complete search history.

(56) References Cited

U.S. PATENT DOCUMENTS

| | | | | |
|---|---|---|---|---|
| 3,586,830 | A | | 6/1971 | Leitner et al. |
| 3,637,984 | A | | 1/1972 | Irvine |
| 4,039,928 | A | | 8/1977 | Noftsker et al. |
| 4,046,991 | A | | 9/1977 | Sefton et al. |
| 4,053,733 | A | | 10/1977 | Murata et al. |
| 4,088,871 | A | | 5/1978 | Coulmance et al. |
| 4,111,443 | A | | 9/1978 | Sullivan et al. |
| 4,166,944 | A | | 9/1979 | Scott |
| 4,167,663 | A | | 9/1979 | Granzow, Jr. et al. |
| 4,223,207 | A | | 9/1980 | Chow |
| 4,337,388 | A | | 6/1982 | July |
| 4,362,924 | A | | 12/1982 | Story et al. |
| 4,449,032 | A | | 5/1984 | Frerking |
| 4,467,178 | A | | 8/1984 | Swindle |
| 4,467,182 | A | | 8/1984 | Merkel |
| 4,495,402 | A | | 1/1985 | Burdick et al. |
| 4,508,261 | A | * | 4/1985 | Blank ..... 236/20 R |
| 4,535,931 | A | | 8/1985 | Bartok et al. |
| 4,564,141 | A | | 1/1986 | Montgomery et al. |
| 4,620,667 | A | | 11/1986 | Vandermeyden et al. |
| 4,777,350 | A | | 10/1988 | Crockeet et al. |
| 4,819,587 | A | | 4/1989 | Tsutsui et al. |
| 4,832,259 | A | | 5/1989 | Vandermeyden |
| 4,834,284 | A | | 5/1989 | VanderMeyden |
| 4,845,342 | A | | 7/1989 | Chen |
| 4,859,834 | A | | 8/1989 | Hausler et al. |
| 4,893,610 | A | | 1/1990 | Kang |
| 4,894,520 | A | | 1/1990 | Moran |
| 4,900,900 | A | | 2/1990 | Shirae et al. |
| 4,906,820 | A | | 3/1990 | Haarmann et al. |
| 4,922,861 | A | | 5/1990 | Tsutsui et al. |
| 4,950,872 | A | | 8/1990 | Chen |

(Continued)

*Primary Examiner*—Thor S. Campbell
(74) *Attorney, Agent, or Firm*—Michael Best & Friedrich LLP

(57) ABSTRACT

A storage-type water heater and method of operating the storage-type water heater. The water heater includes a water tank for storing water, at least one heating element to heat the stored water, a jacket surrounding at least a portion of the tank, and a control system for controlling the water heater. In one construction of the water heater, the water heater includes two heating elements, and the control system includes three temperature sensors and two moisture sensors. The control system can also include circuitry for detecting errors and change operation of the water based on a detected error.

20 Claims, 1 Drawing Sheet

U.S. PATENT DOCUMENTS 4,978,838 A 12/1990 Sanjuan
5,006,695 A 4/1991 Elliott
5,019,690 A 5/1991 Knepler
5,025,134 A 6/1991 Bensoussan et al.
5,079,784 A 1/1992 Rist et al.
5,090,305 A 2/1992 Lehman
5,168,545 A 12/1992 Hart
5,293,446 A 3/1994 Owens et al.
5,305,418 A 4/1994 Tuttle
5,315,291 A * 5/1994 Furr ..... 340/605
5,367,602 A 11/1994 Stewart
5,437,002 A 7/1995 Bennett
5,442,157 A 8/1995 Jackson
5,582,755 A 12/1996 Maher, Jr. et al.
5,588,088 A 12/1996 Flaman
5,660,328 A 8/1997 Momber
5,679,275 A 10/1997 Spraggins et al.
5,723,846 A 3/1998 Koether et al.
5,831,250 A 11/1998 Bradenbaugh
5,949,960 A 9/1999 Hall
6,080,973 A 6/2000 Thweatt, Jr.
6,242,720 B1 6/2001 Wilson et al.
6,265,699 B1 7/2001 Scott
RE37,745 E 6/2002 Brandt et al.
2001/0031138 A1 10/2001 Troost, IV
2002/0146241 A1 10/2002 Murashashi et al.

* cited by examiner

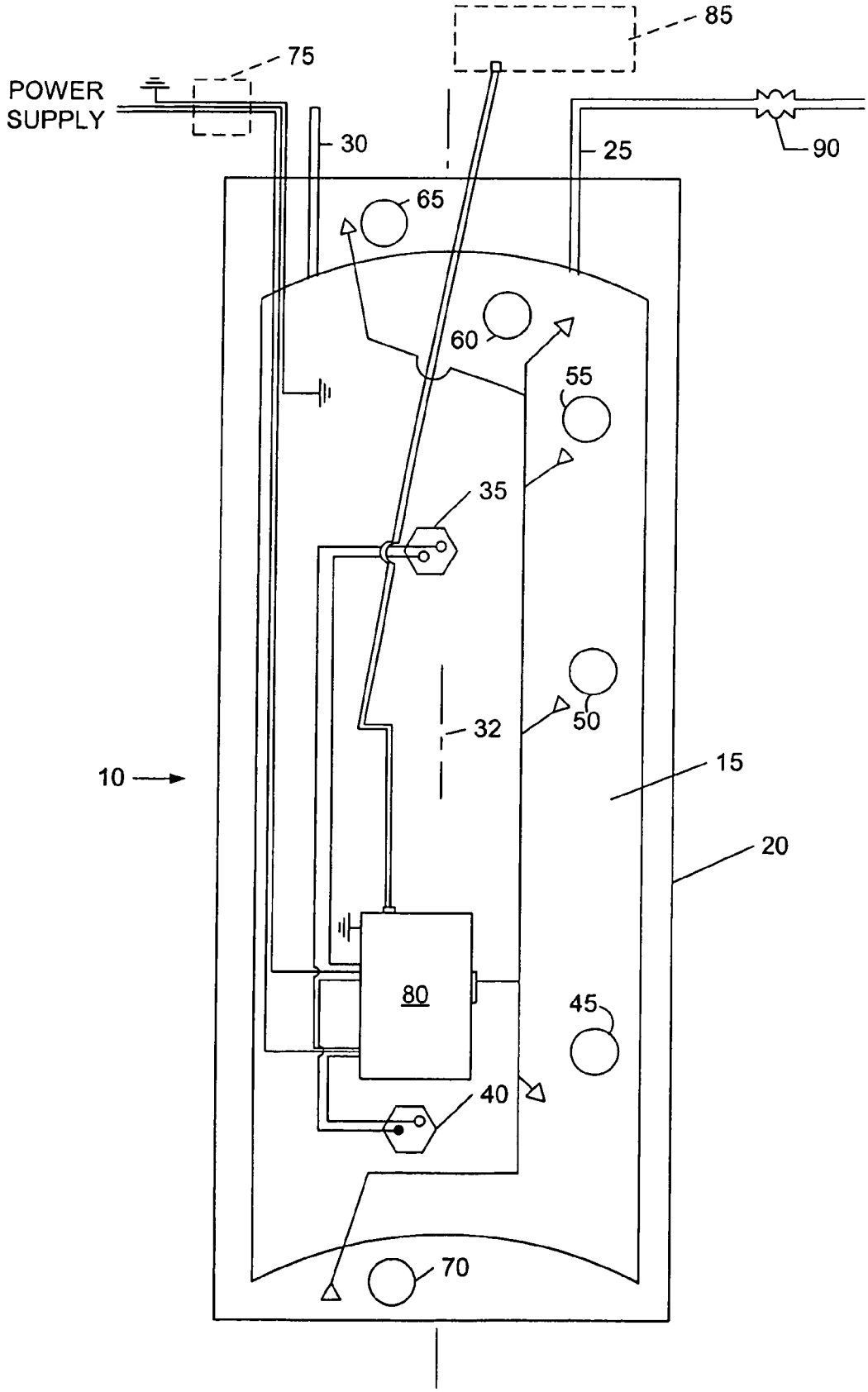
85
75
POWER
SUPPLY
30
25
90
65
60
55
35
32
50
10
15
20
80
45
40
70

WATER HEATER AND METHOD OF OPERATING THE SAME

This application is a divisional patent application of U.S. patent application Ser. No. 10/782,703, filed Feb. 19, 2004, which claims the benefit of the filing date of U.S. Provisional Patent Application No. 60/448,245, filed on Feb. 19, 2003.

BACKGROUND

The invention relates to a water heater and method of operating the same.

SUMMARY

In one embodiment, the invention provides a storage-type water heater including a water tank and a control system. The water tank has an inner surface and a vertical axis. The control system includes first and second electric-resistance heating elements coupled to the tank. The first and second heating elements include first and second thermal surfaces, respectively, disposed within the inner surface of the tank at first and second locations, respectively. The control system also includes first, second, and third temperatures sensors. The first and second temperature sensors are associated with the first and second heating elements, respectively. The third temperature sensor is coupled to the tank at a third location disposed vertically between the first and second locations.

The invention also provides a method of heating water stored by the storage-type water heater. In one embodiment, the method includes sensing a first temperature with the first temperature sensor; sensing a second temperature with the second temperature sensor; preventing power to the second heating element and controllably providing power to the first heating element if the first temperature is below a first set point, the second temperature is above a second set-point, and zero or more other conditions exist; preventing power to the first heating element and controllably providing power to the second heating element if the second temperature is below a second set point and zero or more other conditions exist; and preventing power to the first and second heating elements if the first and second temperatures are above the first and second set points, respectively, and zero or more other conditions exist.

In another embodiment, the invention provides a storage-type water heater having a water tank for storing water, a heating element to heat the stored water, a jacket surrounding at least a portion of the tank, and a control system comprising a moisture sensor disposed between the tank and the jacket. The control system is operable to prevent the heating element from heating the tank if the moisture sensor generates a moisture value greater than a threshold and zero or more other conditions exist. In another construction, the control system can close a solenoid valve to prevent water from entering the tank.

The invention also provides a method of controlling the operation of a storage-type water heater. The method comprises controllably providing power to the first and second heating elements to heat water stored in the water tank; detecting the failure of one of the first and second heating elements; if detecting the failure of one of the first and second heating elements and zero or more other conditions exist, preventing power to the failed heating element, and controllably providing power to the non-failed heating element to heat water stored in the water tank.

Other aspects and embodiments of the invention will become apparent by consideration of the detailed description and accompanying drawings.

BRIEF DESCRIPTION OF THE DRAWING

The FIGURE is a schematic representation of a water heater incorporating the invention.

DETAILED DESCRIPTION

Before any embodiments of the invention are explained in detail, it is to be understood that the invention is not limited in its application to the details of construction and the arrangement of components set forth in the following description or illustrated in the following drawing. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

As shown in the FIGURE, the water heater 10 has a water tank 15, an insulation jacket 20 surrounding the tank 15, and water inlet and outlet spuds 25, 30 respectively, for connection to a cold water supply and the hot water pipes of a building, respectively. For the construction shown, there are upper and lower (with respect to axis 32) electrical heating elements 35, 40 in the respective upper and lower portions of the water tank 15. Other constructions of the water heater can include a different number of heating elements and the location of the elements may vary. The water heater 10 also has a control system that includes four temperature sensors 45, 50, 55, 60, two water sensors 65, 70, a current sensor 75 on the power circuit, a switch box or module 80, and an operator panel 85. Other constructions of the water heater can include different or additional control sensors, and it should be understood that not all of the control sensors shown are required for all constructions.

Referring again to the construction shown in the FIGURE, the control sensors (i.e., all of the sensors in the control system), heating element connections, and all associated interconnections are located in the insulation space between the tank 15 and the outer protective jacket 20. The temperature sensors 45, 50, 55, 60 are respectively positioned just above the lower heating element 40, between the upper and lower heating elements 35, 40, just above the upper heating element 35, and near the top of the tank 15. The temperature sensors are in intimate contact with the tank walls, and may be, for example, thermistor type sensors.

In the construction shown, sensors 55 and 45 are used to control the upper and lower heating elements 35, 40, respectively. Sensor 50 is used to determine the need for automatic boost. For example, this sensor 50 could be used to detect an excessive drawoff situation. The control system could have an algorithm to detect this situation and initiate a heating pattern (earlier actuation of the upper heating element than would normally occur with only an upper and lower temperature sensor). This can result in a faster hot water recovery time in the water heater. Sensor 60 is used to monitor the temperature of the hottest water in the tank 15 in a dedicated high limit circuit.

The water sensors 65, 70, also referred to herein as moisture sensors, are positioned at the top and bottom of the water heater 10 to detect water leaks, and may be in or under the insulation jacket 20. In one construction, the upper sensor is located under the jacket top or on top of the water heater tank and be capable of detecting a leak due to, for example, faulty plumbing connections. The bottom water sensor 70 could be relocated to a drip pan if one is included in the water heater 10. In one construction, the bottom water sensor detects a leak that would be from a tank weld failure or faulty threaded component (e.g., heating element, drain valve, etc.). Referring to the construction shown in the FIGURE, the electrically operated solenoid valve 90 is installed on the incoming water supply line and is powered from the control system. The control can have an algorithm to detect the appropriate signal from the water sensors 65, 70 and actuate (close) the electric solenoid valve on the incoming water supply to prevent water damage to the surrounding area.

The switch box 80 is mounted within, outside of, or on top of the water heater jacket 20. The control system derives its power from a 110 volt, 240 volt, or 480 volt power supply. The switch box 80 receives control instructions (or signals) from the user interface panel 85 and provides all of the current-handling interfaces between the heating elements 35, 40 and the building electrical circuits. The switch box 80 contains all power switching components for the heating elements 35, 40, the controller power supply, any necessary processing devices, and all sensing and power connection terminations. The control sensors are electrically connected to the switch box. The switch box can also contain a first current sensor associated with the first heating element and a second current sensor associated with the second heating element. The first and second current sensors sense a current to the first and second heating elements 35, 40, respectively.

In one construction of the water heater, the switch box 80 includes therein a high temperature limit relay switch for interrupting power to the heating elements 35, 40 when the temperature sensor 60 determines that the temperature at the top of the tank 15 has exceeded the set temperature. The high limit switch is capable of switching up to 40 amps at 240 volts. There is also a manual switch on the operator panel to permit the operator to manually reset the high limit switch when the temperature of the water at the top of the tank 15 has fallen to a programmed safe temperature. In at least one construction of the water heater, the automatic relay and the manual switch define a double pole circuit for isolation of the electric power supply to the water heater 10. In the event of an over temperature situation, both poles of the supply to the water heater are interrupted. Referring again to the FIGURE, there are also heating element relay switches (e.g., electronic relay switches, electromechanical relay switches, or a combination thereof) in the switch box 80 for controlling power to the upper and lower heating elements 35, 40. The heating element relay switches are capable of switching 30 amps at 240 volts.

The operator panel 85 shown in the FIGURE includes a programmable central processing unit (CPU) that controls the operation of the control system. However, other programmable devices and/or processing or control units or circuits can be used with the water heater 10. The operator panel 85 operates on utility power, but also includes a battery backup power source for program retention in the event of a power failure. The operator panel 85 may be mounted on the water heater jacket 20, remotely from the water heater 10 in the same room (e.g., on a wall), in another room in the building, or even outside of the building. The interface between the switch box 80 and the user interface panel 85 may include a 2-wire bus system, a 4-wire bus system, or a radio wave signal.

The CPU is programmable via a user interface on the operator panel 85. The user interface includes a touch pad or keyboard and a visual display, both of which are backlit for ease of operation. Using the interface, the operator may set an "OFF" temperature within a permissible range (e.g., 90–150° F. for residential applications and 90–180° F. for commercial applications), and an "ON" temperature that, in one construction, must be at least 3° F. below the OFF temperature. As the names imply, the OFF temperature is the temperature at which the control system turns the heating elements 35, 40 OFF, and the ON temperature is the temperature at which the control system turns one of the heating elements 35, 40 ON. In some constructions, the heating elements 35, 40 have different ON and/or OFF temperatures.

The ON/OFF program may, for example, define a 24 hour, 7 day schedule or a 24 hour, 5 weekday and 2 weekend day schedule, any of which can define multiple ON and OFF temperatures. The operator may manually override the ON/OFF program. The CPU also accommodates vacation programming, in which the control system reduces the water temperature for the duration specified by the operator.

The CPU is additionally programmed to automatically accommodate excessive draw off situations (i.e., when the temperature of the water is reduced rapidly over a short time period) by going into boost mode to decrease the recovery time (i.e., make the water heater 10 recover from excessive draws faster). In boost mode, the control system energizes the upper heating element instead of the lower heating element to quickly boost the water temperature at the top of the tank 15. Once the upper heating element 35 reaches its set point, which may be set at a higher temperature (such as the highest set point temperature for the current 24 hour period) than the normal ON temperature for the upper heating element 35, normal automatic operation of the heating system will resume.

The operator panel 85 also provides a switch for manually switching the control system into boost mode. This will allow the user to initiate a heating sequence that will reset the thermostat set point to the highest programmed value for the day, which, if the water temperature is below this value, will force the water heater ON. Once the set point is achieved, the thermostat will automatically reset to the programmed value and normal heater operation will resume.

The operator panel 85 includes indicators for the mode of the control system (e.g., manual, automatic, boost, or vacation). It also includes a "power on" indicator and an indicator for each heating element 35, 40 to indicate whether the element is active. Such indicators would aid both the installer and the end user. The operator panel 85 also includes a port (e.g., an RS232 port) for computer hookup.

In the construction shown, the control system prevents simultaneous operation of the upper and lower heating elements 35, 40. In one method of operation, the CPU uses the following control sequence. If the temperature sensor 55 is below the set point of the upper heating element 35, output to the lower element 40 is disabled and the upper element 35 is turned ON. If the temperature sensor 55 is above the set point of the upper heating element 35, and temperature sensor 45 is below the set point of the lower element 40, the lower element 40 is turned ON. If the temperature sensor 45 is above the set point of the lower heating element 40, both outputs are turned OFF. If the temperature sensor 50 senses a rapid temperature drop, the lower element 45 is disabled and the upper element 35 is turned ON in the automatic boost mode. Other methods for controlling the elements 35 and 40 are possible.

The operator panel 85 provides troubleshooting and error detection features, which use the above-described control sensors to detect problems, and announce the problem to the operator via the visual display and/or an alarm (sound and/or lights). For example, when the control system detects that one of the heating elements 35, 40 has failed, it switches power to the other heating element and alerts the operator of the failure. The control system may detect such failure (1) when no current is sensed in the element circuit despite the associated sensor (55, 45) being below its set point, (2) when the measured resistance in the element indicates an open circuit element, or (3) when current is sensed and no temperature rise is sensed in the tank 15 in a defined time period. The system will also monitor the heating elements 35, 40 for scale buildup. If the rate of change of resistance in the heating elements or heat up rate indicate excessive scale on the element, the operator will be notified by a display and/or an alarm.

The control system will, in addition to alerting the operator, shut down the water heater 10 when the water sensors 65, 70 detect a water leak, when the control system detects dry fire (i.e., one of the heating elements 35, 40 being energized in the absence of water in the tank 15), when the current sensor 75 detects current leak to ground, and when the current sensor 75 detects that the water heater 10 is not grounded. Dry fire is detected when there are abnormal current and resistance readings in the heating element circuit. Current to ground occurs when there is no voltage potential on one leg of the power supply circuit due to current leakage to the heating elements 35, 40.

The control would incorporate a voltage sensor on each of the incoming powered leads with the ability to measure voltage potential to chassis ground. If no (or a threshold value to be determined) voltage potential to ground exists on both legs of the incoming powered leads, the building circuit is not properly grounded. The control would have an algorithm to detect this condition and turn off the electrical input to the heater and/or alert the owner that an unsafe (ungrounded) situation exists.

The control system knows that the heater 10 is not grounded when there is no voltage potential on both legs of the power supply circuit.

The control system also incorporates an electrical output for control of an optional electric solenoid valve 90 on the incoming water supply. This optional valve will be closed upon detection of certain conditions and appropriate monitoring signals to prevent water damage to the building from leakage or to prevent a safety hazard to user.

An additional feature of the control system is the ability to measure and monitor power consumption. Power consumption is a function of the wattage of an electric heating element and the time during which it is under power. The CPU is able to keep track of the time portion of the power consumption equation, but the OEM or operator is required to program the wattage of the heating elements 35, 40 for the feature to work properly. The control system displays the power consumption of the water heater on the visual display of the user interface 85.

Along with the current sensor to the conductor on each heating element, the control incorporates a timer which increments with current flow to the heating elements, i.e., when current is flowing the timer would increment. With heating element wattage input to the controller, the controller would have an algorithm to calculate and store power consumption. This power consumption could be continual or reset daily, monthly, annually, or on any time frame chosen by the user.

The control system also includes a voltage sensor on each of the incoming powered leads with the ability to measure voltage potential to chassis ground. If either no voltage potential to ground exists on both legs of the incoming powered leads, or if the voltage potential drops below a threshold value, the building circuit is not properly grounded. The control has an algorithm to detect this condition and turn off the electrical input to the heater and/or alert the owner that an unsafe (ungrounded) situation exists.

With a voltage sensor on each of the incoming powered leads and a current sensor on the conductor to each heating element, the controller has an algorithm capable of continually calculating the 'hot' (while under load) resistance of each heating element. The controller calculates this resistance when the heating element is initially energized, as a baseline, and continually monitors the resistance for comparison to this initial resistance. This ability allows detection of a dry-fire condition (energization of a heating element with no water in the tank) as well as scale buildup on the element. The control contains an algorithm capable of detecting a resistance pattern indicative of a dry-fired element and a resistance pattern indicative of excessive scale buildup on the heating element. In either event, the control alerts the owner that the tank contains no water or that the heating element is facing imminent failure.

The algorithms for detecting dry-fire and scale buildup take into consideration the rate of change of resistance as a function of time, and compare that rate of change of resistance to the characteristics of the brand-new, clean heating element baseline information. A heating element may burn out in within one to two minutes of dry-firing. The algorithm for determining the dry-fire condition may, for example, be based on the rate of increase in resistance over the first few seconds or less of element operation (e.g., a 3–10% increase in resistance in the first 2–10 seconds). For some heating elements, for example, a 5% increase in resistance in the first three seconds of element operation may be a good indicator of dry-firing. Early detection of dry-firing permits the control to save the heating element by shutting it down quickly.

Thus, the invention provides, among other things, a new and useful water heater and method of operating a water heater. The constructions of the water heater and the methods of operating the water heater described above and illustrated in the figure are presented by way of example only and are not intended as a limitation upon the concepts and principles of the invention. Various features and advantages of the invention are set forth in the following claims.

The invention claimed is:

1. A storage-type water heater comprising:

a water tank comprising an inner surface and a vertical axis; and a control system comprising a first electric-resistance heating element coupled to the tank, the first heating element comprising a thermal surface disposed within the inner surface at a first location, a second electric-resistance heating element coupled to the tank, the second heating element comprising a thermal surface disposed within the inner surface at a second location disposed vertically from the first location, a first temperature sensor coupled to the tank and associated with the first heating element, a second temperature sensor coupled to the tank and associated with the second heating element, and a third temperature sensor coupled to the tank at a third location disposed vertically between the first and second locations wherein the first and second temperature sensors sense first and second temperatures, respectively, having a relation to the water temperature, and wherein the control system comprises a controller operable to receive the first and second temperatures and control the first and second heating elements based on the first and second temperatures, wherein the third temperature sensor senses a third temperature having a relation to the water temperature, and wherein the controller is further operable to determine a boost state based on the third temperature sensor.

2. A storage-type water heater as set forth in claim 1 wherein the first temperature sensor is disposed at a location vertically above the first heating element, and wherein the second temperature sensor is disposed at a location vertically above the second heating element.

3. A storage-type water heater as set forth in claim 2 wherein the first temperature sensor is disposed adjacent to the first heating element, and wherein the second temperature sensor is disposed adjacent to the second heating element.

4. A storage-type water heater as set forth in claim 1 wherein the first location is in a substantially lower portion of the tank and the second location is in a substantially higher portion of the tank, and wherein the third location is substantially between the first and second locations.

5. A storage-type water heater as set forth in claim 4 wherein the third location is in a vertically closer proximity to the second heating element.

6. A storage-type water heater as set forth in claim 1 wherein the control system further comprises a programmable controller.

7. A storage-type water heater as set forth in claim 1 wherein the storage-type water heater further comprises a cold-water inlet and a hot-water outlet, and wherein the control system further comprises a fourth temperature sensor coupled to the tank at a fourth location associated with the hot water outlet.

8. A storage-type water heater as set forth in claim 7 wherein the fourth temperature sensor senses a fourth temperature having a relation to the water temperature, and wherein the control system further comprises a high-temperature-limit relay switch to interrupt power to the first and second heating elements if the fourth temperature exceeds a set-point temperature and zero or more other conditions exist.

9. A storage-type water heater as set forth in claim 1 wherein the water heater further comprises a jacket surrounding at least a portion of the tank and wherein the control system further comprises a moisture sensor disposed between the tank and the jacket.

10. A storage-type water heater as set forth in claim 1 wherein the water heater further comprises a drip pan disposed beneath at least a portion of the tank, and the wherein the control system further comprises a moisture sensor disposed between the tank and the drip pan.

11. A storage-type water heater comprising:

a water tank comprising an inner surface and a vertical axis; and a control system comprising a first electric-resistance heating element coupled to the tank, the first heating element comprising a thermal surface disposed within the inner surface at a first location, a second electric-resistance heating element coupled to the tank, the second heating element comprising a thermal surface disposed within the inner surface at a second location disposed vertically from the first location, a first temperature sensor coupled to the tank and associated with the first heating element, the first temperature sensor being configure to sense a first temperature having a relation to the water temperature, a second temperature sensor coupled to the tank and associated with the second heating element, the second temperature sensor being configure to sense a second temperature having a relation to the water temperature, a third temperature sensor coupled to the tank at a third location disposed vertically between the first and second locations, the third temperature sensor being configure to sense a third temperature having a relation to the water temperature, wherein the control system is operable to receive the first and second temperatures and control the first and second heating elements based on the first and second temperatures, and wherein the control system is further operable to determine a boost state based on the third temperature sensor.

12. A storage-type water heater as set forth in claim 11 wherein the storage-type water heater further comprises a cold-water inlet and a hot-water outlet, and wherein the control system further comprises a fourth temperature sensor coupled to the tank at a fourth location associated with the hot water outlet.

13. A storage-type water heater as set forth in claim 12 wherein the fourth temperature sensor senses a fourth temperature having a relation to the water temperature, and wherein the control system further comprises a high-temperature-limit relay switch to interrupt power to the first and second heating elements if the fourth temperature exceeds a set-point temperature and zero or more other conditions exist.

14. A storage-type water heater as set forth in claim 11 wherein the water heater further comprises a jacket surrounding at least a portion of the tank and wherein the control system further comprises a moisture sensor disposed between the tank and the jacket.

15. A storage-type water heater as set forth in claim 11 wherein the water heater further comprises a drip pan disposed beneath at least a portion of the tank, and the wherein the control system further comprises a moisture sensor disposed between the tank and the drip pan.

16. A storage-type water heater as set forth in claim 11 wherein the first location is in a substantially lower portion of the tank and the second location is in a substantially higher portion of the tank, and wherein the third location is substantially between the first and second locations.

17. A storage-type water heater as set forth in claim 16 wherein the third location is in a vertically closer proximity to the second heating element.

18. A storage-type water heater comprising:

a water tank comprising an inner surface and a vertical axis; and a control system comprising a first electric-resistance heating element coupled to the tank, the first heating element comprising a thermal surface disposed within the inner surface at a first location, a second electric-resistance heating element coupled to the tank, the second heating element comprising a thermal surface disposed within the inner surface at a second location disposed vertically from the first location, a first temperature sensor coupled to the tank and associated with the first heating element, a second temperature sensor coupled to the tank and associated with the second heating element, and a third temperature sensor coupled to the tank at a third location disposed vertically between the first and second locations wherein the first and second temperature sensors sense first and second temperatures, respectively, having a relation to the water temperature, and wherein the control system comprises a controller operable to receive the first and second temperatures and control the first and second heating elements based on the first and second temperatures, wherein the programmable controller controls the first heating element based on the first temperature and the second heating element based on the second temperature, and wherein the programmable controller determines a boost state based on the third temperature sensor.

19. A storage-type water heater as set forth in claim 18 wherein the first temperature sensor is disposed at a location vertically above the first heating element, and wherein the second temperature sensor is disposed at a location vertically above the second heating element.

20. A storage-type water heater as set forth in claim 19 wherein the first temperature sensor is disposed adjacent to the first heating element, and wherein the second temperature sensor is disposed adjacent to the second heating element.

* * * * *